US006565522B1

(12) United States Patent
Chen

(10) Patent No.: US 6,565,522 B1
(45) Date of Patent: May 20, 2003

(54) MASSAGING DEVICE PROVIDED WITH MEANS TO APPLY CLEANSING LOTION TO BODY PART BEING MASSAGED

(76) Inventor: Ching-Hsi Chen, P.O. Box 453, Taichung (TW)

( * ) Notice: Subject to any disclaimer, the term of this patent is extended or adjusted under 35 U.S.C. 154(b) by 0 days.

(21) Appl. No.: 10/047,400

(22) Filed: Jan. 16, 2002

(51) Int. Cl.[7] ..... A61H 15/00
(52) U.S. Cl. ..... 601/118; 401/208
(58) Field of Search ..... 601/118, 122, 601/128, 131, 17–19, 22; D24/211, 214; 401/208

(56) References Cited

U.S. PATENT DOCUMENTS 1,947,042 A * 2/1934 Glennan ..... 401/174
4,441,487 A * 4/1984 Daugherty et al. ..... 601/17
4,846,159 A * 7/1989 Anzai et al. ..... 601/128
6,405,390 B2 * 6/2002 Kuen ..... 4/622

* cited by examiner

*Primary Examiner*—Justine R. Yu

(57) ABSTRACT

A massaging device comprises a base, a massaging member, and a cover. The base is provided with a basin for containing the cleansing lotion. The massaging member is rotatably mounted in the base such that the massaging member is partially submerged in the cleansing lotion. The cover is provided with an opening and is joined with the base such that the massaging member is partially jutted out of the cover via the opening. The massaging member is provided in the outer surface with a plurality of grooves and ridges, which dispense and apply the cleansing lotion to a body part being massaged by the massaging member in motion.

1 Claim, 5 Drawing Sheets

MASSAGING DEVICE PROVIDED WITH MEANS TO APPLY CLEANSING LOTION TO BODY PART BEING MASSAGED

BACKGROUND OF THE INVENTION

1. Field of the Invention

The present invention relates generally to a massaging device, and more particularly to a massaging device capable of cleaning a body part while the body part is being massaged by the massaging device.

2. Description of Related Art

The conventional sole massaging device is generally provided with bristles and the like fro cleaning the sole which is being massaged; nevertheless it is devoid of an applicator for applying the cleansing agent to the sole.

BRIEF SUMMARY OF THE INVENTION

The primary objective of the present invention is to provide a massaging device with means to apply a cleansing lotion to the soles which are being massaged by the massaging device.

In keeping with the principle of the present invention, the foregoing objective of the present invention is attained by the massaging device comprising a base, a massaging member, and a cover. The base is provided with a basin for containing a cleansing lotion. The massaging member is partially submerged in the cleansing lotion. As the massaging member is rotated, the cleansing lotion is applied to the soles which are being rubbed.

The features and the advantages of the present invention will be more readily understood upon a thoughtful deliberation of the following detailed description of the present invention with reference to the accompanying drawings.

DETAILED DESCRIPTION OF THE INVENTION

Figure 1:
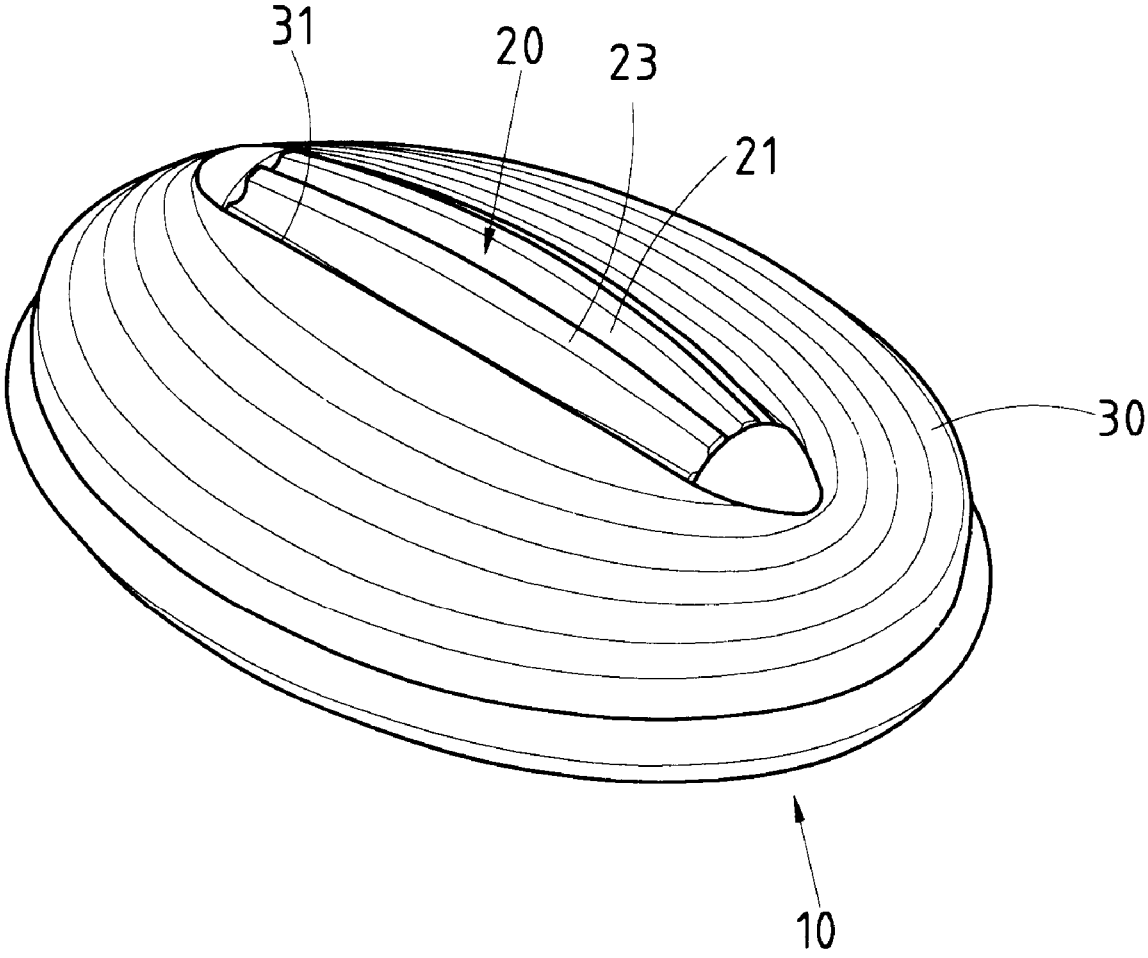
FIG. 1 shows a perspective view of the present invention.
Figure 2:
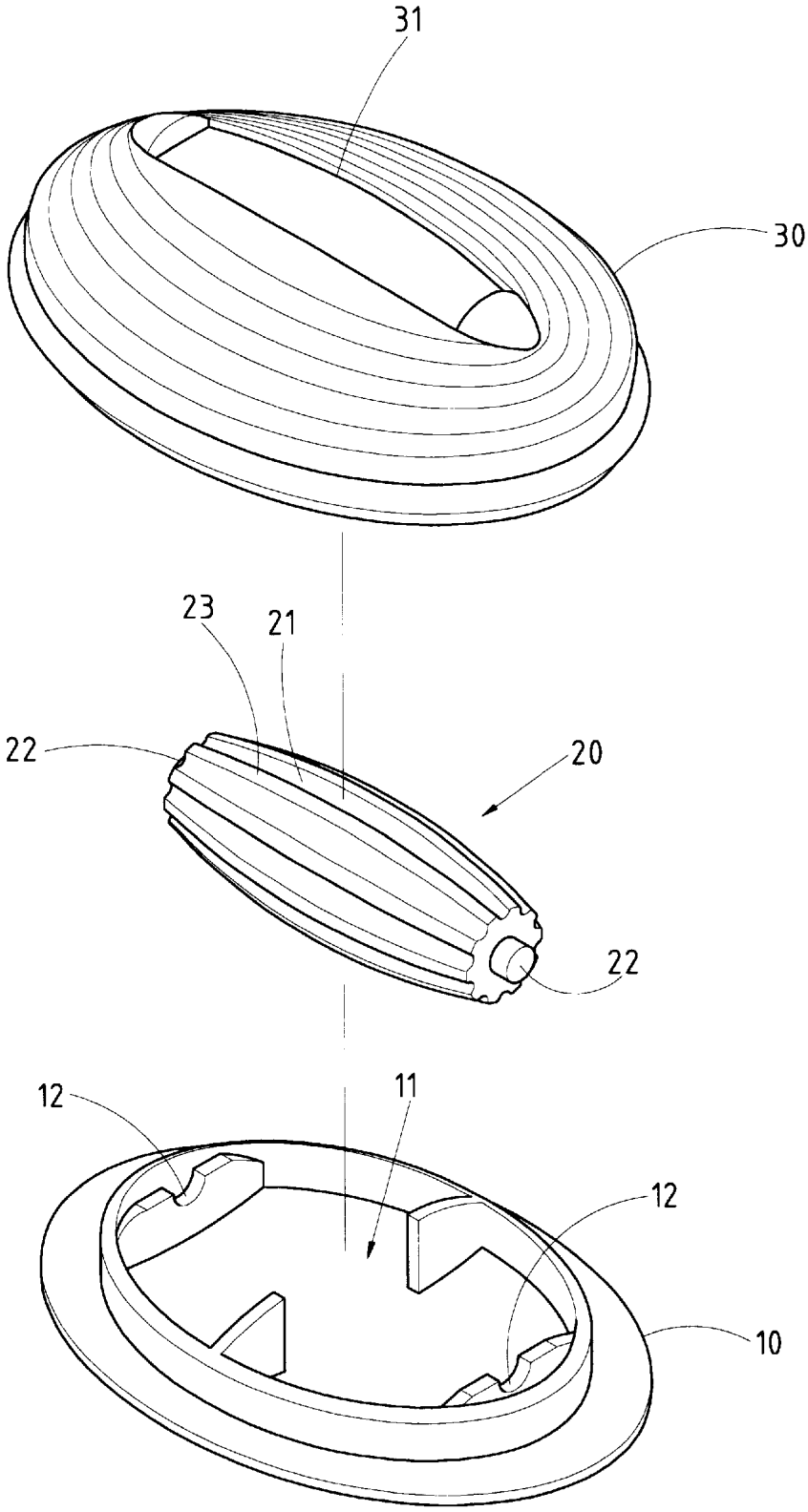
FIG. 2 shows an exploded view of the present invention.
Figure 3:
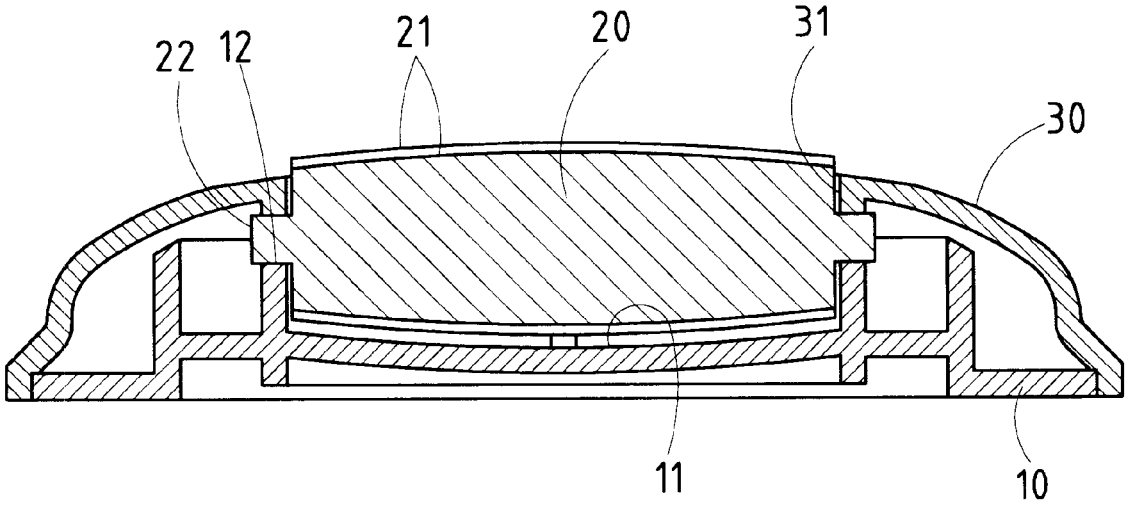
FIG. 3 shows a sectional view of the present invention in combination.

As shown in FIGS. 1–4, a sole-massaging device embodied in the present invention comprises a base 10, a massaging member 20, and a cover 30.

The base 10 is provided with a basin 11 which is in turn provided in two opposite side walls thereof with a shaft hole 12.

The massaging member 20 is of a cylindrical construction and is provided in the outer surface with a plurality of grooves 21 and ridges 23, which extend along the longitudinal direction of the cylindrical massaging member 20. The massaging member 20 is provided at two longitudinal ends with a projection 22 which is dimensioned to fit rotatably into the shaft hole 12 of the basin 11 of the base 10, thereby enabling the massaging member 20 to turn in the basin 11 of the base 10.

The cover 30 is provided with an opening 31 which is corresponding in size and shape to the massaging member 20. The cover 30 is joined with the base 10 such that the grooves 21 and the ridges 23 of the massaging member 20 are jutted out of the cover 30 via the opening 31.

Figure 4:
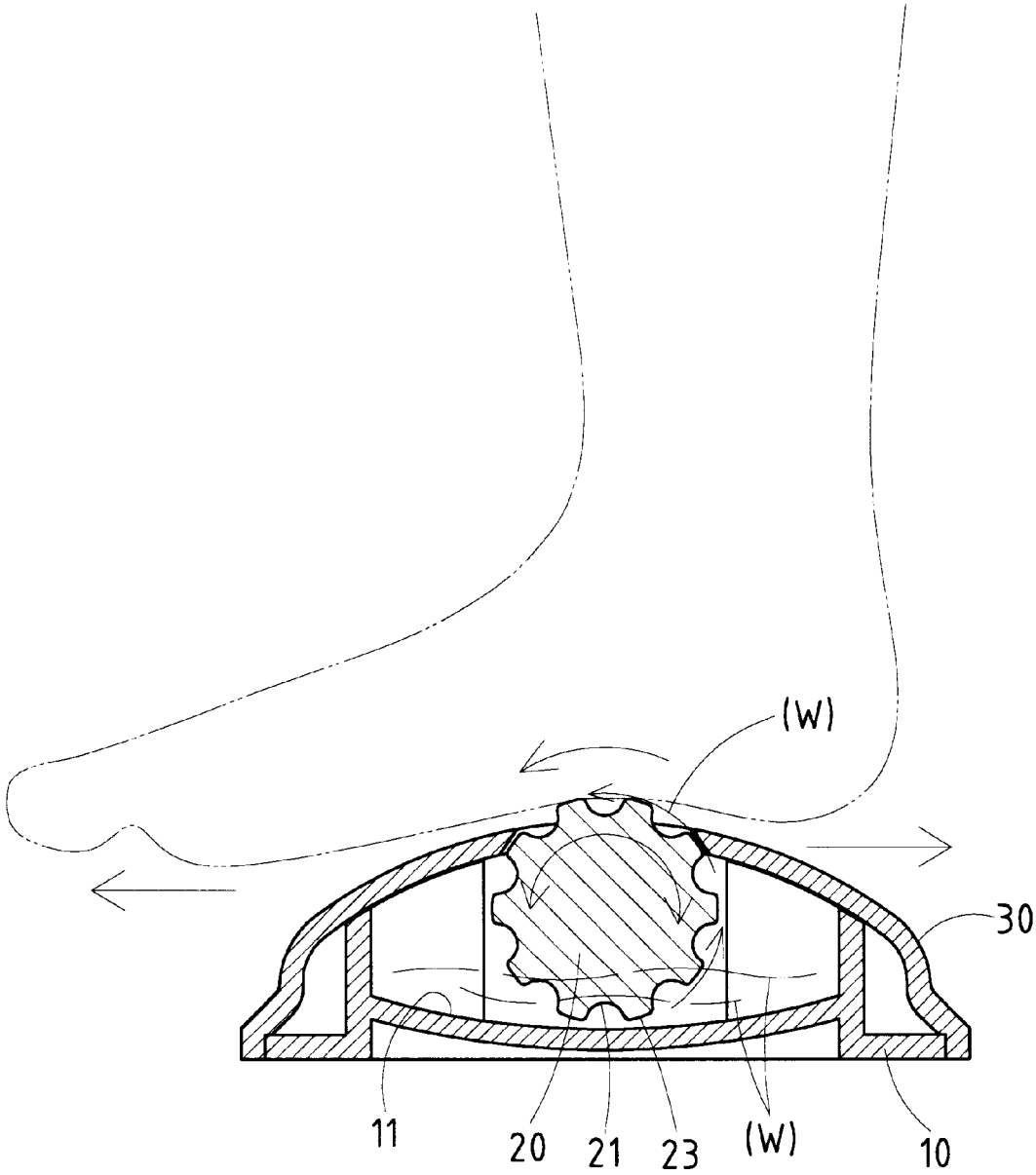
FIG. 4 shows a sectional schematic view of the present invention at work.

As illustrated in FIG. 4, a cleansing lotion "W" is held in the basin 11 of the base 10. A sole comes in contact with the massaging member 20 such that the sole pushes the massaging member 20 to turn. In light of the massaging member 20 being partially submerged in the cleansing lotion "W", the grooves 21 and the ridges 23 of the massaging member 20 in motion pick up the cleansing lotion "W", which is then applied to the sole being massaged by the ridges 23 of the massaging member 20.

Figure 5:
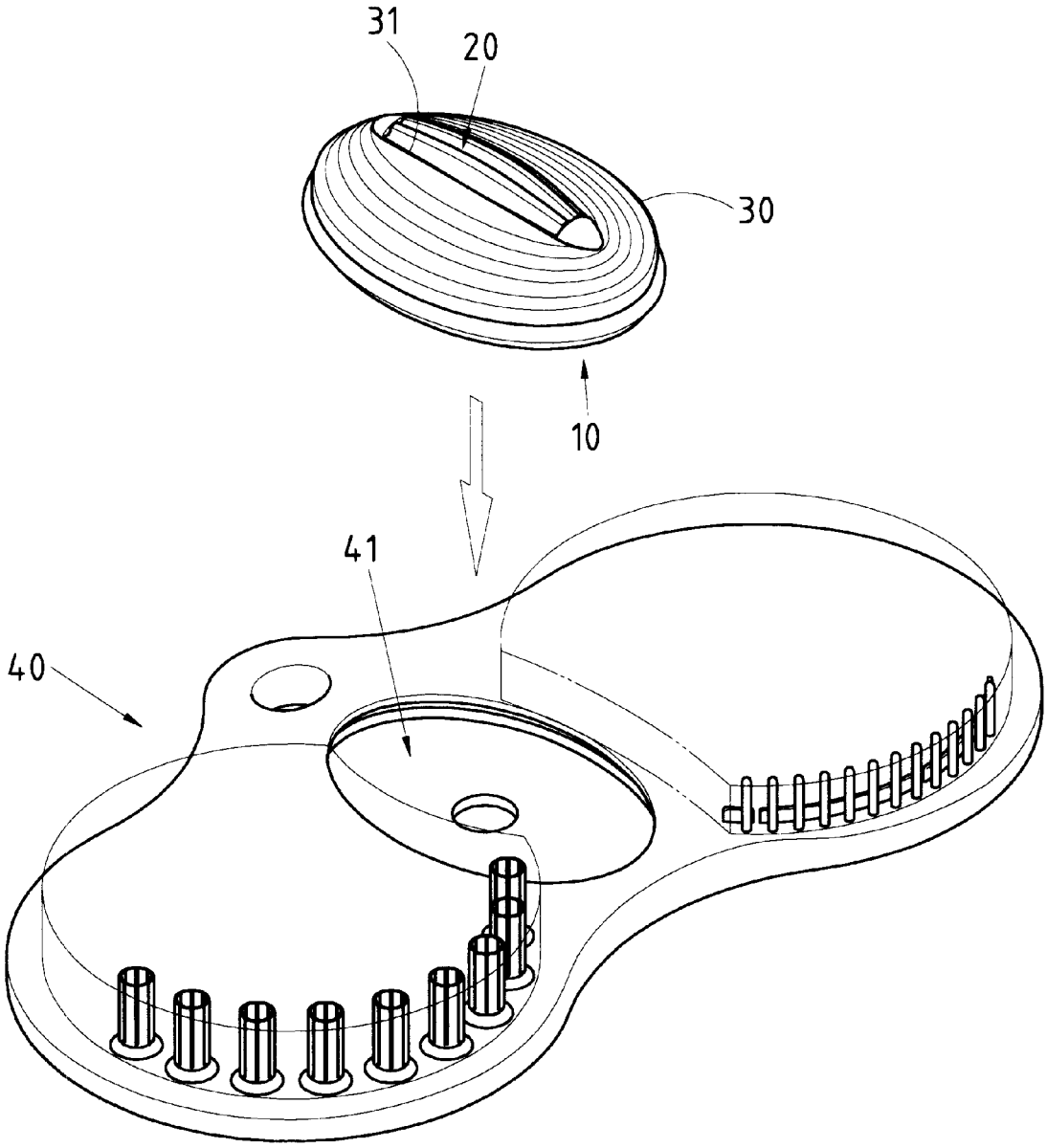
FIG. 5 shows a schematic view of the present invention being used in conjunction with a sole stimulator.

As shown in FIG. 5, the massaging device of the present invention is used in conjunction with a sole stimulator 40 which is provided with a locating slot 41 to accommodate the base 10 of the massaging device of the present invention.

The present invention described above is to be regarded in all respects as being illustrative and nonrestrictive. Accordingly, the present invention may be embodied in other specific forms without deviating from the spirit thereof. The present invention is therefore to be limited only by the scope of the following claim.

I claim:

1. A massaging device comprising:

a base provided with a basin for holding a cleansing lotion, said basin being provided in two opposite side walls with a shaft hole;

a massaging member of a cylindrical construction and provided at two longitudinal ends thereof with a projection, said massaging member being rotatably mounted in said base such that said projection of said massaging member is rotatably received in said shaft hole of said basin of said base, and that said massaging member is partially submerged in the cleansing lotion, contained in said basin of said base; and a cover provided with an opening corresponding in size and shape to said massaging member, said cover being joined with said base such that said massaging member is partially jutted out of said cover via said opening of said cover;

wherein said massaging member is provided in an outer surface with a plurality of grooves and ridges, said grooves and said ridges being extended along the longitudinal direction of said massaging member whereby said grooves and said ridges dispense and apply the cleansing lotion to a body part being massaged by said ridges of said massaging member in motion.

* * * * *